US008251234B2

(12) United States Patent
Rigert et al.

(10) Patent No.: US 8,251,234 B2
(45) Date of Patent: Aug. 28, 2012

(54) TEAT

(75) Inventors: Mario Rigert, Buchrain (CH); Carmelo Piscitello, Hochdorf (CH); Alex Stutz, Baar (CH); Erich Pfenniger, Ebikon (CH)

(73) Assignee: Medela Holding AG, Baar (CH)

( * ) Notice: Subject to any disclaimer, the term of this patent is extended or adjusted under 35 U.S.C. 154(b) by 346 days.

(21) Appl. No.: 12/483,054

(22) Filed: Jun. 11, 2009

(65) Prior Publication Data

US 2009/0314736 A1 Dec. 24, 2009

(30) Foreign Application Priority Data

Jun. 12, 2008 (CH) ..... 897/08
Feb. 6, 2009 (CH) ..... 176/09

(51) Int. Cl.
*A61J 9/00* (2006.01)

(52) U.S. Cl. ..... 215/11.1; 215/11.4; 215/11.5; 215/11.6

(58) Field of Classification Search ..... 215/11.1, 215/11.5, 11.4
See application file for complete search history.

(56) References Cited

U.S. PATENT DOCUMENTS

| | | | | | |
|---|---|---|---|---|---|
| 582,159 | A | | 5/1897 | Heller | |
| 689,987 | A | * | 12/1901 | Pick | 215/11.5 |
| 981,072 | A | * | 1/1911 | Decker | 215/11.1 |
| 1,543,427 | A | * | 6/1925 | Denney | 215/11.1 |
| 1,569,693 | A | * | 1/1926 | Young | 215/11.4 |
| 1,656,157 | A | * | 1/1928 | Correnti | 215/11.1 |
| 1,735,670 | A | * | 11/1929 | Blumenfeld | 215/11.1 |
| 1,902,433 | A | * | 3/1933 | Brown | 215/11.1 |
| 1,904,710 | A | * | 4/1933 | Barkan | 215/11.1 |
| 2,133,411 | A | * | 10/1938 | Zohe | 215/11.1 |
| 3,207,349 | A | | 9/1965 | Rabe | |
| 3,704,803 | A | * | 12/1972 | Ponder | 215/11.2 |
| 4,623,069 | A | * | 11/1986 | White | 215/11.1 |
| 5,244,105 | A | * | 9/1993 | Serre | 215/11.5 |
| 5,704,505 | A | | 1/1998 | Singh | |
| 5,897,007 | A | * | 4/1999 | Schein et al. | 215/11.1 |
| 6,126,679 | A | * | 10/2000 | Botts | 606/236 |
| 2003/0071006 | A1 | | 4/2003 | Kolb | |
| 2007/0181520 | A1 | * | 8/2007 | Holley et al. | 215/11.1 |

FOREIGN PATENT DOCUMENTS

| | | |
|---|---|---|
| GB | 347368 | 4/1931 |
| GB | 2226014 | 6/1990 |
| JP | 01-244761 | 9/1989 |
| WO | 2004/002276 A1 | 1/2004 |

* cited by examiner

*Primary Examiner* — Tri Mai
(74) *Attorney, Agent, or Firm* — McDonnell Boehnen Hulbert & Berghoff LLP

(57) ABSTRACT

A teat for connection to a receiving unit of a drink container has a main body and, adjoining the main body and tapered relative to the main body, a mouthpiece with at least one suction opening and a free end. The teat has a first connector element for connection to the receiving unit, and a second connector element for connection to the receiving unit, and a suction channel. The suction channel extends within the mouthpiece, opens via a first end into the suction opening and is directed via a second end towards the main body. This second end forms the first connector element for a substantially leak-tight connection to the receiving unit. The main body is designed such that it can be turned back towards the free end of the mouthpiece. The teat is designed such that it can be turned back at least a second location. The teat according to the invention can be connected to the feeding bottle in a simple and hygienic manner, is easy to clean and permits a feeding action that is as true to nature as possible.

14 Claims, 6 Drawing Sheets

TEAT

CROSS-REFERENCE TO RELATED APPLICATIONS

This application claims priority to Swiss Patent Application No. 00897/08 filed Jun. 12, 2008, and also claims priority to Swiss Patent Application No. 00176/09 filed on Feb. 6, 2009. The entire disclosure content of these applications are herewith incorporated by reference into the present application.

BACKGROUND OF THE INVENTION

The invention relates to a teat.

A wide variety of teats for feeding bottles are known in the prior art. Teats should be easy to secure in place and easy to clean. Moreover, they should allow the baby to feed in a manner that is as true to nature as possible, such that the baby can switch back and forth between the mother's breast and the feeding bottle without nipple confusion.

Most of the known teats are concentrated on seeking an optimal solution to one of the aforementioned problems. However, many of these teats are of a complicated construction and are also relatively expensive to manufacture.

U.S. Pat. No. 7,320,678, for example, discloses a teat with a radially outwardly protruding flange, and with a cylindrical suction tube which extends within the mouthpiece and protrudes into the main body of the teat and through which the milk is sucked from the bottle to the suction opening of the mouthpiece. This suction tube has to be plugged into a corresponding receiving tube in the receiving unit. This is quite difficult to do. Moreover, this teat cannot be easily cleaned.

SUMMARY OF THE INVENTION

It is therefore an object of the invention to create an optimized teat and an optimized teat unit.

This object was achieved by a teat and a teat unit having the features of the claimed invention.

The teat according to an aspect of the invention for connection to a receiving unit of a drink (liquid) container has a main body and, adjoining the main body and tapered relative to the main body, a mouthpiece with at least one suction opening, through which the liquid emerges from the teat, and a free end. The teat has a first connector element for connection to the receiving unit, a second connector element for connection to the receiving unit, and a suction channel. The suction channel extends within the mouthpiece. It opens via a first end into the suction opening and is directed via a second end towards the main body. This second end forms the first connector element for leaktight connection to the receiving unit. According to the invention, the main body is designed such that it can be turned back towards the free end of the mouthpiece, and the teat is also designed such that it can be turned back at least one second location.

The teat has a stable basic state, a first stable turned-back state and at least a second stable turned-back state, wherein the at least second stable state differs in outward appearance from the first stable state and from the basic state.

The mouthpiece preferably has two sections, and the mouthpiece is designed such that it is adapted to be turned back in the transition area between these two sections.

The mouthpiece is preferably designed such that it is adapted to be turned back in an area between its free end and its transition to the main body.

In a preferred embodiment, the suction channel extends at least partially in a tube that extends at least partially in the interior of the mouthpiece and is spaced apart from an inner face of the mouthpiece. The tube has a first tube end, which is connected to the mouthpiece. A second, free tube end forms the second end of the suction channel. According to the invention, the first end of the tube ends, at a distance from the free end of the mouthpiece, in the interior of the mouthpiece.

The suction opening is preferably located in the free end of the mouthpiece, i.e. in its front tip, and is in the form of a single hole. The suction opening in the front area of the mouthpiece can also be arranged laterally instead of in the tip. In both variants, it can also be formed by several holes.

This teat of the present invention has several advantages. It separates the "sealing" and "securing" functions. The first connecting means seals the connection of the suction channel to the receiving unit, and thus to the interior of the drink container, from the rest of the teat and thus also from the outside. However, the teat itself is connected to the receiving unit particularly by the second connecting means, preferably a circumferential flange of the main body. This connection is subject to standards that have to be met. The teat must not come loose from the drink container in the event of the baby pulling it forcibly or at an angle during feeding.

Since the main body in its first outward form is turned back or inverted, the first connector element is more easily accessible. It can therefore be connected more easily to the receiving unit.

If the gap between mouthpiece and tube is designed widening towards the mouthpiece, the tube can quite easily be pushed back into the mouthpiece from the second inverted state, thus re-establishing the normal position of use. This can be achieved, for example, by virtue of the fact that the mouthpiece, at least over the area through which the tube passes, is conical and/or the tube is designed as a hollow cylinder in this area.

A further advantage is that the teat when turned back once, and in particular the teat when turned back twice, can be better cleaned, since any complex structures in the interior of the main body, for example the first connector element, lie free and can be better accessed for cleaning.

The teat can also be manufactured in one piece, for example, in the once turned-back state, and in particular in the twice turned-back state. This makes manufacture easier and also reduces the manufacturing costs. Moreover, the inner area of the teat, in particular the gap between tube and mouthpiece, can be more easily provided with radial or axial ribs, indentations, knobs or other internal structures.

The mouthpiece, in an upper area adjacent to the suction opening, is preferably designed with a single wall, and, in a lower area adjacent to the main body, with a double wall.

In the turned-back state of the main body, surfaces are exposed which can be touched and which, during the intended use of the teat, do not come into contact with a liquid flowing through the teat. The teat can be correctly connected to the receiving unit simply by holding it via these surfaces. The teat can be connected to or mounted on the receiving unit without the use of additional aids or tools.

This is a further advantage, because the teat can be gripped only at parts which subsequently, during its intended use, do not enter the baby's mouth and are not in contact with the milk or the drinking liquid. It is thus ensured that the teat can also be fitted in place under high standards of hygiene. This is very important, especially in premature babies and neonates. The turned-back main body can be gripped via its inner face, and the mouthpiece does not have to be touched at any time. Since the tubular suction channel is present in the interior of the main body, the inner face of the main body also does not come into contact with the drinking liquid.

The suction channel preferably extends between the first tube end and the suction opening within a chamber in the interior of the mouthpiece. This chamber changes shape during the feeding process and adapts, like the natural nipple of the mother's breast, to the feeding action and to the baby's mouth.

The mouthpiece and the tube are preferably flexible, at least in the area of the chamber, so as to be able to adapt to the feeding action optimally and in a manner as true as possible to nature.

In a preferred illustrative embodiment, the mouthpiece comprises, between the mouthpiece and the tube, at least one extensible zone which extends separately from the at least one suction channel and which, during use, lies between the palate and tongue of a baby. This zone is designed such that it stretches or in particular inflates when an underpressure is generated by the baby in its mouth during feeding. The gap thus forms an open chamber filled with air.

This teat permits a simulation that is as true to nature as possible, such that nipple confusion when changing from the teat to the mother's natural breast can be avoided.

Spacers in the form of radial or axial ribs, knobs, indentations or other surface structures can be arranged in the gap between tube and mouthpiece, and these spacers prevent the walls of the tube and of the mouthpiece from attaching to each other or remaining fixed to each other during feeding.

Tests during feeding have shown that there are important aspects other than the extensibility of the mouthpiece during feeding and the avoidance of closure of the milk channel. The interaction of teat, palate and tongue is also important. The teat according to the invention takes into account the natural interaction of palate, tongue and nipple. Since the teat has an air chamber that inflates cyclically during feeding, the teat, just like the mother's nipple, is able to follow the tongue and/or palate movement of the baby and optimally fill the oral cavity as the mother's nipple does.

In a preferred embodiment, the air chamber does not just inflate in a direction perpendicular to the longitudinal axis of the teat. By virtue of its three-dimensional increase in size, the mouthpiece of the teat is lengthened and extends as far as the soft palate of the child.

This extension is preferably reversible, such that the zone expands cyclically during feeding, and according to the feeding rhythm, and its volume is then reduced again.

The mouthpiece, in particular the suction channel, is preferably flexible along almost its entire length. The tube or the suction channel is preferably just as soft as, or even softer than, the outer wall of the mouthpiece. However, the tube can also be harder or stiffer. This soft and flexible configuration permits optimal adaptation of the radial teat shape to the baby's feeding action, since the mouthpiece is able to optimally follow the tongue and/or palate movement. Moreover, this configuration also allows the mouthpiece to lengthen during feeding. The lengthening of the mouthpiece is preferably also reversible during and in accordance with the feeding cycle.

The teat according to the invention most preferably takes into account the interaction of palate, tongue and teat. In particular, during the feeding phase in which the rear area of the tongue is lowered, it allows the teat to bear with practically its entire upper surface completely on the baby's palate. Moreover, the teat bears with practically its entire lower surface on the baby's tongue during the feeding phase in which the rear area of the tongue is raised.

Ultrasound images of a baby feeding at its mother's breast have shown that the baby switches cyclically between two feeding phases. In a phase A, the rear area of the baby's tongue is raised and presses against the hard palate. In a phase B, this rear area of the tongue is lowered. The ultrasound images have also shown that the nipple is pulled lengthwise until just before the transition from the hard palate to the soft palate. The baby generates an underpressure in its mouth by moving the rear area of its tongue downwards in phase B. The upper lip on the one hand, and the tongue and/or the lower lip on the other hand, form a tight seal to the outside. The baby's soft palate helps to maintain the underpressure (negative pressure) during feeding. The soft palate forms a pharyngeal seal so as to maintain the vacuum in the oral cavity. In phase A, the nipple has a coronal cross section in the form of an ellipse, the major semi-axis lying horizontally. In phase B, the nipple is pretensioned by the maximum vacuum and has an approximately round cross section. By means of the cyclical upward and downward movement of the tongue, the diameter of the nipple thus changes in the same cycle. The coronal cross section changes its shape cyclically, with the cross-sectional surface area in phase B being slightly reduced compared to that in phase A. The teat according to the invention now simulates this effect.

The air chamber of the teat is preferably at atmospheric pressure and inflates in the presence of an external underpressure. In this way, the external diameter increases like the nipple. The air chamber changes its volume in the same cycle as the baby raises and lowers its tongue. If at least the upper side of the teat is provided with an air chamber of this kind, it is ensured that the teat, just like the nipple, bears on the baby's hard palate during phase B.

The teat according to the invention can be used in a teat unit for sucking a liquid from a liquid container. This teat unit comprises the teat and a flow restrictor with a through-opening. The teat has a mouthpiece and, formed integrally on the mouthpiece, a main body that widens relative to the mouthpiece, wherein the mouthpiece has a suction opening. The flow restrictor determines a maximum flow of the liquid passing through the suction opening from the liquid container. According to the invention, the flow restrictor is arranged outside the mouthpiece. The suction opening has a greater cross-sectional surface area than the through-opening of the flow restrictor.

This teat unit permits a feeding action that is as true to nature as possible. By virtue of the large opening, the mouthpiece, also called nipple, is able to deform easily during feeding and adapts optimally to the movements of the baby's mouth and tongue. The baby has a sensation in its mouth similar to the sensation when feeding on the natural nipple of a mother's breast. The mouthpiece is flexible and, during its intended use, there are preferably no parts protruding into and stiffening the mouthpiece along a substantial part of its length. The mouthpiece is therefore preferably deformable during its intended use.

Typical diameters are 3 to 8 mm for a round suction opening and 0.2 to 0.7 mm for a round flow restrictor.

However, the flow restrictor is arranged outside the mouthpiece, i.e. outside the part taken into the baby's mouth during the intended use. In this way, the baby is unable to influence the flow restrictor by means of mechanical pressure or pulling, caused by movements of its lips and mouth.

The teat unit according to aspects of the invention thus separates the following functions:

- adaptation and deformation of the mouthpiece in a manner that is as true to nature as possible,
- flow restriction, to ensure that the baby does not choke.

The teat according to the invention can also be used in a teat unit for sucking a liquid from a liquid container, which teat unit comprises the teat and a flow restrictor with a through-opening. The teat has a mouthpiece and, formed integrally on the mouthpiece, a main body that widens relative to the mouthpiece, wherein the mouthpiece has a suction opening. The flow restrictor determines a maximum flow of the liquid passing through the suction opening from the liquid container. According to this aspect of the invention, the flow restrictor is arranged outside the mouthpiece, and the teat unit has a one-way valve which is arranged outside the mouthpiece, and wherein the flow restrictor is arranged in the one-way valve or in an area adjacent thereto.

This teat unit permits feeding in a manner that is as true to nature as possible, since only atmospheric pressure or underpressure prevails in the teat unit. No overpressure develops. Therefore, the milk does not squirt into the baby's mouth, and instead it flows into the mouth in accordance with the vacuum applied by the baby. The flow of milk is thus more or less proportional to the vacuum applied by the baby.

This teat unit permits feeding which is controlled purely by vacuum and is largely independent of the other movement, in particular the peristaltic movement, of the tongue. When the rear area of the tongue moves towards the upper palate, no milk should be able to flow. When this rear area moves away from the upper palate, the milk then flows.

This teat unit makes use of the knowledge that the baby does not switch back and forth between vacuum and atmospheric pressure during feeding. Rather, it maintains a basic vacuum throughout the entire feeding process. In contrast to the arrangements according to the prior art, the valve now closes when this basic vacuum is reached. When the absolute value of the applied vacuum rises above this basic vacuum, the valve opens and the milk or liquid is able to flow. Despite maintaining the basic vacuum, the baby is thus able to pause, catch its breath, or take a rest and gather renewed strength, which is also what happens at the mother's breast. The device according to the invention preferably already opens at a slight underpressure of from 1 to 90 mmHg, preferably 20 to 70 mmHg. More preferred values are between 20 and 30 mmHg and between 5 and 30 mmHg. In absolute terms, these values are just above a typical basic vacuum applied by a baby.

However, during feeding, the valve has no further influence on the flow of milk. The degree of opening and mode of operation of the valve do not influence the flow of milk through the suction opening.

Since the nonreturn valve and the flow restrictor are arranged outside the mouthpiece, any deformation of the mouthpiece does not influence the function of the non-return valve. The baby is therefore unable to exert any influence on the nonreturn valve by mechanical pressure and/or pulling.

In a first embodiment, the nonreturn valve covers the through-opening of the flow restrictor. In a preferred embodiment, however, the nonreturn valve does not cover the relatively small through-opening of the flow restrictor but instead a larger opening. This opening is preferably arranged upstream of the flow restrictor in the direction of flow of the liquid, i.e. directed towards the liquid container. However, it can also be arranged downstream of the flow restrictor in the direction of flow.

In other embodiments, the opening of the flow restrictor is located in the stiff valve seat, i.e. here in the base part. This opening can in this case be covered and closed by the valve diaphragm. However, it can also be arranged adjacent thereto and lead into the dead volume.

In another embodiment, the opening of the flow restrictor can be arranged in the valve diaphragm and can be closed by means of the diaphragm bearing sealingly on the valve seat. In this case, the discharge opening is arranged adjacent thereto in the valve seat and is not closed by the diaphragm but instead leads into the dead volume. The discharge opening can be the same size as or larger than the opening of the flow restrictor.

The flow restrictor can thus be arranged in, over or under the valve diaphragm.

Since the valve and the flow restrictor, or the discharge opening and the valve, are arranged adjacent to each other, this minimizes the dead volume in which a vacuum likewise has to be generated. The valve or the teat also functions perfectly at low flow rates.

Preferably, the valve is easily detachable and the teat unit is therefore easy to clean. If a diaphragm is used, it can be held by clamping it between individual parts.

Instead of a diaphragm clamped in place with or without a well-defined opening cross section, it is also possible to use a screen valve, a spout valve or a slotted diaphragm.

Further objectives, advantages and embodiments are set forth herein.

BRIEF DESCRIPTION OF THE SEVERAL VIEWS OF THE DRAWINGS

The subject matter of the invention is explained below on the basis of a preferred illustrative embodiment, which is depicted in the attached drawings. Identical parts are provided with the same reference signs. In the drawings.

DETAILED DESCRIPTION OF THE INVENTION

A preferred illustrative embodiment of the teat according to the invention is depicted in FIGS. 1 to 5.

Figure 5:
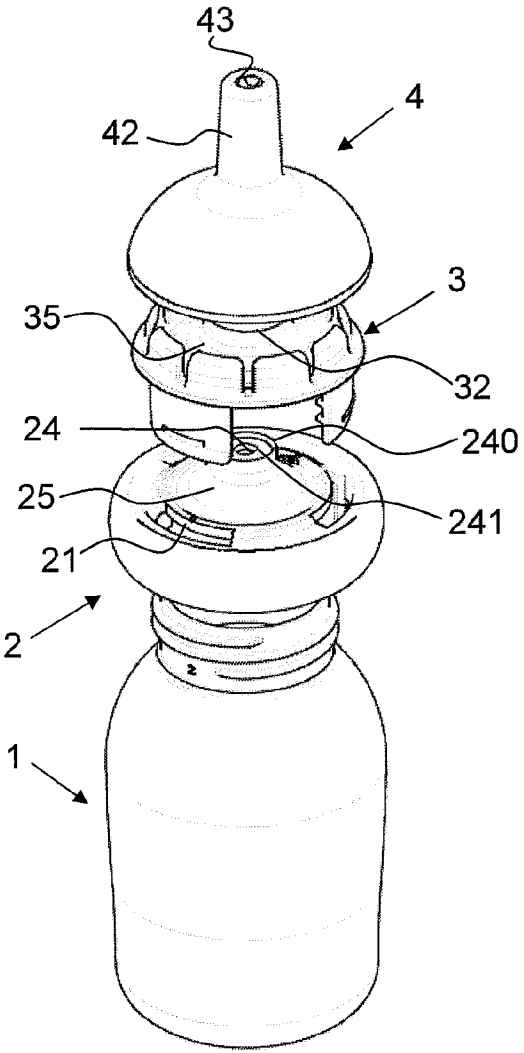
FIG. 5 shows an exploded view of the unit according to FIG. 4.
Figure 4:
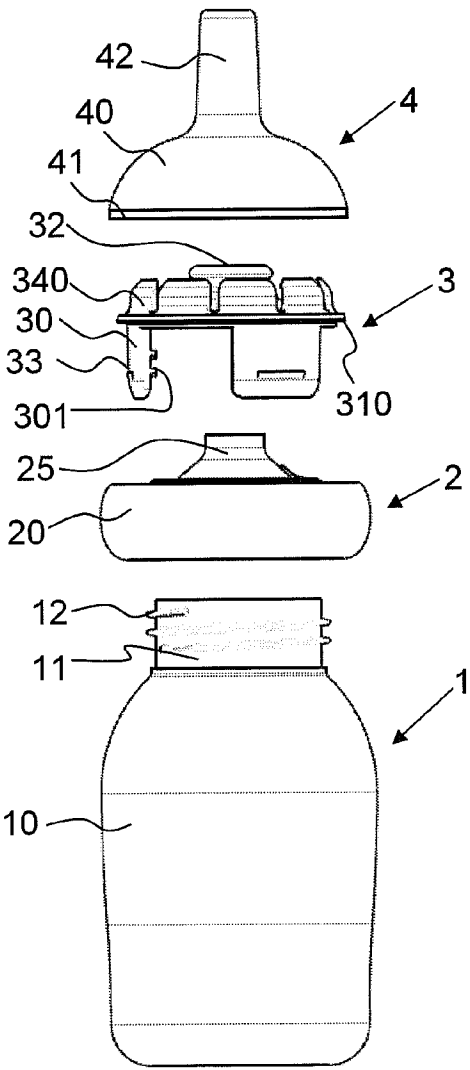
FIG. 4 shows a side view of a baby's bottle with a receiving unit and with the teat according to FIG. 1.

FIGS. 4 and 5 show a liquid container, for example a baby's feeding bottle 1, with a neck 11 that has an outer thread 12. A teat 4 can be secured on the baby's feeding bottle 1 by means of an assembly unit or receiving unit 2, 3.

The receiving unit 2, 3 is composed principally of two parts: a base part 2 and a receiving head 3. The base part 2 is preferably made of polypropylene (PP) or a polyamide, while the receiving head 3 is made of a combination of PP or a polyamide with silicone, rubber or TPE. For the teat 4, silicone, a silicone-based plastic, rubber or TPE is preferably used.

The base part 2 is dimensionally stable (substantially or generally rigid). It is composed principally of an annular body 20 and of a truncated cone 25 formed integrally on the latter. Centrally in the truncated cone 25, there is a through-opening or discharge opening 24 which serves as the inlet opening of the unit and which connects the interior of the container 1 to the outside, i.e. to the teat. The truncated cone 25 protrudes above the annular body 20 and extends upwards towards the receiving head 3. The discharge opening 24 is preferably arranged in the uppermost area, preferably in the flattened tip.

This base part 2 can be fitted onto the container neck 11, but without already being positionally fixed relative to the latter, in particular secured against rotation. A lower abutment is present which limits how far the container neck 11 can pass through the base part 2, i.e. how far the base part 2 can slip down on the container neck 11. For example, the abutment can be an inner contact surface in the upper area of the base ring 2. Other types of abutments are also possible, for example projecting lugs or ribs.

The receiving head 3 is also annular and preferably rotationally symmetrical. The receiving head 3 is composed principally of two areas. The lower and preferably hard area is formed here by several plug elements 30 which form sections of a common jacket that are distributed uniformly about the circumference. The plug elements 30 form a common inner thread 301 on their inner face. Instead of an inner thread, an outer thread can also be present if the drink container 1 is provided with a corresponding inner thread.

The plug elements 30 can be plugged into slits or slots 21 of the base part 2. Locking ribs 33 on the base part and on the receiving head 3 prevent the receiving head 3 from falling out of the base part 2.

The upper area of the receiving head 3 can be made of the same material as the lower area, or of a softer material. It can be of any desired configuration in the peripheral area. It preferably has peripheral supporting bodies or supporting structures, here supporting wings 340, which interact with the suction body or teat 4 described below.

Figure 1:
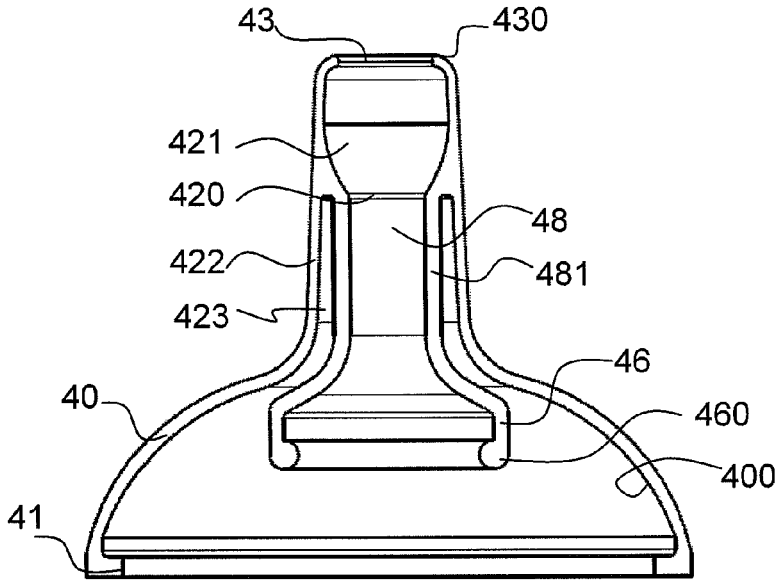
FIG. 1 shows a longitudinal section through a teat according to the invention.
Figure 2:
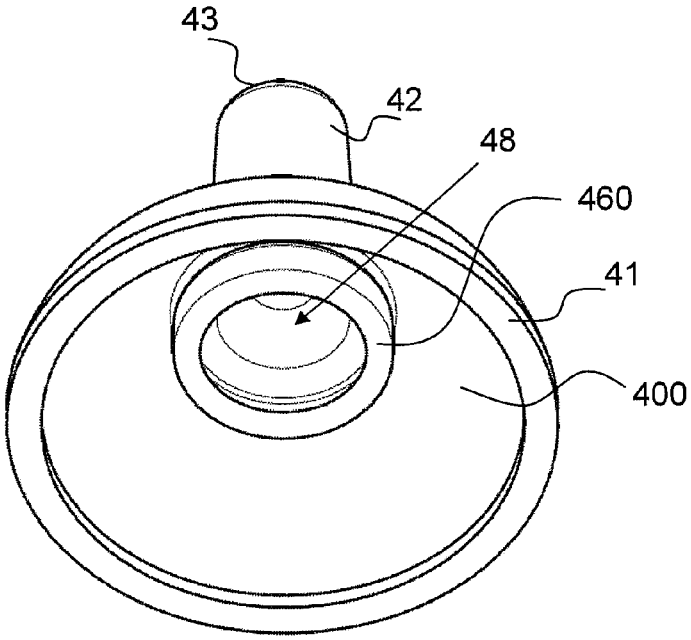
FIG. 2 shows a perspective view of the teat according to FIG. 1 from below.
Figure 3:
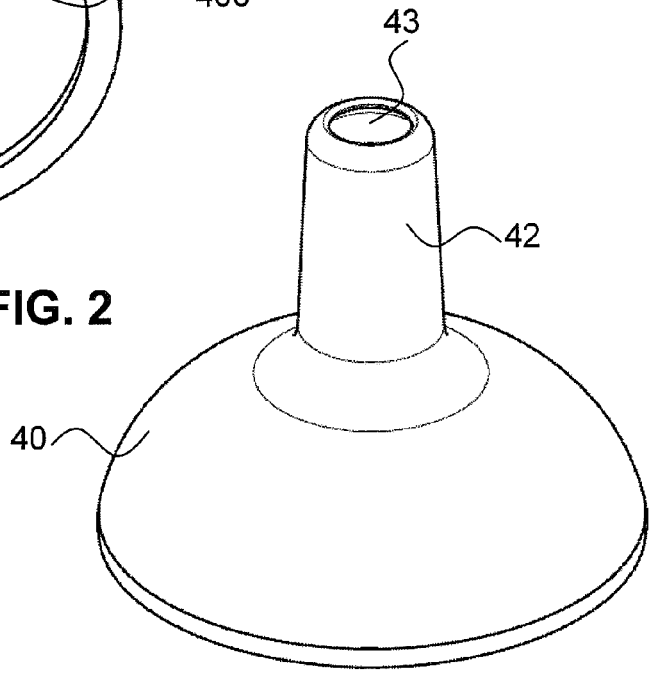
FIG. 3 shows a perspective view of the teat according to FIG. 1 from the side.

The teat 4 can be seen clearly in FIGS. 1 to 3. It is designed in one piece. It has a frustoconical, spherical cap-shaped or semicircular main body 40, and a mouthpiece 42 integrally formed thereon. In its outer circumference, the mouthpiece 42 is tapered relative to the main body 40, or the latter is widened in its outer circumference relative to the mouthpiece. The main body 40 is preferably bent inwards with its lower edge, resulting in a radially inwardly directed flange 41. As is shown here, this flange 41 can be flush with the plane defined by the lower opening of the main body. However, it can also be oriented at a downward angle from the opening of the main body 40. The flange 41 is preferably made relatively narrow and stiffens the lower area of the main body 40 only very slightly, if at all.

The mouthpiece 42 is preferably designed in a known manner as a hollow cylinder or preferably as a truncated cone. It forms a thin-walled hollow body with a suction opening 43. It is resiliently and/or flexibly deformable. The suction opening 43 is present in the mouthpiece 42, preferably in the uppermost tip. During use, the liquid sucked from the container 1 emerges through this suction opening 43.

A suction channel 48, also called the liquid channel or milk channel, extends within the teat 4 and opens at one end into the suction opening 43. At its second end, it protrudes into the main body 40 and forms the inlet opening of the teat 4.

The mouthpiece 42 is designed with a double wall along part of its length. The upper area of the mouthpiece 42 adjacent to the suction opening is designed as a single wall and preferably has a flange 430 protruding radially inwards into the suction opening 43. The lower area directed towards the main body 40 is designed as a double wall. The double-wall configuration preferably begins at a tapered area 420 of the internal cross section of the mouthpiece 42. The inner circumferential and completely closed wall forms a tube 481. It extends spaced apart from the outer wall 422 of the mouthpiece 42. The suction channel 48 extends within this tube 481.

Radial or axial ribs, knobs or other structures can protrude into the gap between the walls 422, 481. These structures can be arranged on the inner face of the outer wall 422 and/or on the outer face of the inner wall 481.

The outer wall 422 of the mouthpiece 42 is preferably frustoconical or conical. This should be true at least of its inner circumference. The outer circumference of the tube 481 preferably has a cylindrical shape. The inner wall 481 can be made just as flexible as the outer wall 422. It is preferably made stiffer, however. As before, however, it is still preferably flexible and not rigid or stiff.

The lower area of the tube 481 protrudes into the main body 40. Its cross section is widened, its shape preferably following the shape of the transition area between mouthpiece 42 and main body 40. However, it also preferably extends here at a distance from the walls thereof. The lower area of the tube 481 is formed by a circumferential skirt 46. This skirt 46 protrudes towards the receiving head 3. An inwardly or outwardly protruding flange 460 is preferably formed integrally on the skirt 46.

Between tube 481 and suction opening 43, the suction channel 48 extends in a chamber or a hollow space 421 which is present in the interior of the mouthpiece 42 and adjoins the tapered area 420. It has a larger cross section than the tapered area 420. This hollow space, like the suction opening too, preferably has a substantially round cross section. Since the mouthpiece 42 is relatively soft, the mouthpiece 42, in particular the chamber 421 and the suction opening 43, is deformed during its intended use. These parts preferably adopt an oval shape. The hollow space 421 can additionally become longer, but narrower. This shape may be changed during feeding by the baby.

The mouthpiece is preferably flexible along its entire length. During its intended use, there are preferably no parts protruding into and stiffening the mouthpiece along a substantial part of its length, with the result that it remains deformable.

In the assembled state, the suction opening 43 is connected to the interior of the container 1 via the hollow space 421, the tube 481 and, subsequently, via the through-opening 32 and the discharge opening 24, such that the baby is able to take its drink, e.g. tea, water or milk, through this opening.

Figure 8:
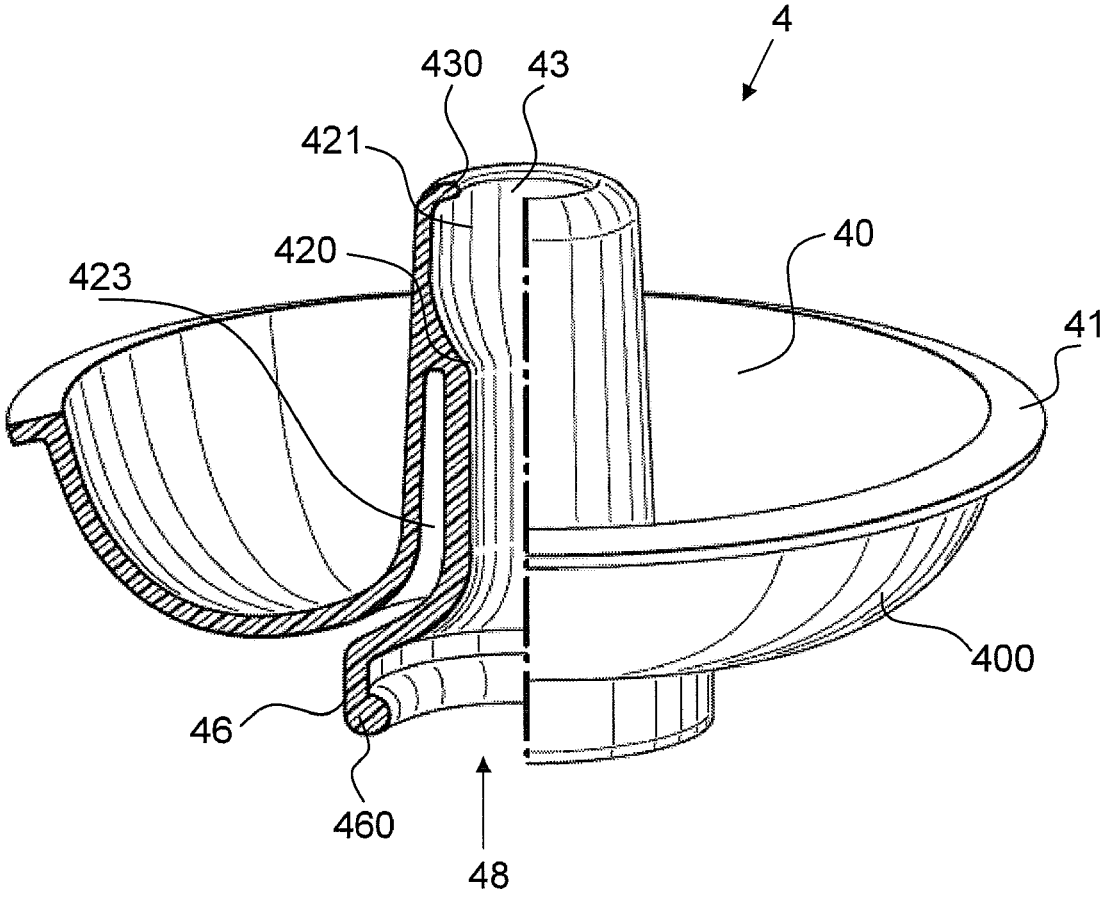
FIG. 8 shows a partial cross section of the teat according to FIG. 1 in a first inverted manifestation.

As can be seen from FIG. 4, the teat 4 can be pushed with its main body 40 over the receiving head 3. According to the invention, the main body 40 is inverted in this process until it has adopted its first turned-back manifestation and, consequently, its second stable position. The mouthpiece 42 is not inverted in this process. This inverting can be done by hand, by gripping the lower edge of the main body 40 and bending it upwards and outwards. The main body 40 thus assumes its second stable position, as is shown in FIG. 8. As can be seen clearly from FIG. 8, in this stable inverted position, the first connecting means or securing means, namely the lower end of the suction channel 48 lies free and protrudes from the inverted main body 40. The teat 4 can now be held via the now outwardly protruding inner surface 400 of the main body 40, and the free end of the tube 481, here the skirt 46, can be pushed over the truncated cone 35 and thus over the through-opening 32 of the receiving head 3. The flange 460 of the skirt 46 engages behind a bead or a rib of the truncated cone 35 and rests sealingly thereon. Since the skirt 46 is easy to see and easily accessible, this can be done in a simple manner.

The main body 40 is now turned back down to its stable position of use, again by means of just the free edge of the main body 40 being pulled downwards. The flange 41 of the main body 40 engages behind the protruding edge between the upper and lower areas of the receiving head 3 and rests flat and sealingly on the outer sealing surface 310 of the receiving head 3. The teat 4 is now fitted on the receiving head 3 in the manner shown in FIG. 3.

The teat 4 can in this way be placed onto the receiving head 3 or partially pushed over the latter. The receiving head 3 can then be plugged into the base part 2. The receiving head 3 can be plugged into the base part 2 when the latter is free, but also when the latter is already located on the container neck 11. Since the base part 2 can still move slightly in the axial direction relative to the receiving head 3, the teat 4 can also optionally be pushed over the receiving head 3 only after the receiving head 3 and base part 2 have been plugged together.

By rotating the base part 2 or the receiving head 3 on the container neck 11, the two threads, namely the outer thread 12 and inner thread 301, mesh with each other. The receiving head 3 runs downwards along the thread. The base part is pulled down with it as far as its lower abutment. The base part 2 and the receiving head 3 are now secured on the container 1 and secured against rotation relative to each other. In this way, the outer sealing face of the base part 2 is now pressed relative to the outer sealing surface 310 of the receiving head 3. They clamp the flange 41 of the teat 4 and thus ensure a liquid-tight and airtight connection between teat 4, receiving head 3 and base part 2. Depending on the particular design, a differently shaped lower edge 41 of the teat 4 can also be clamped sealingly between the two parts 2, 3.

As has been described above, the teat, despite its relatively complicated internal structure, can be easily fitted in place in this way.

Figure 9:
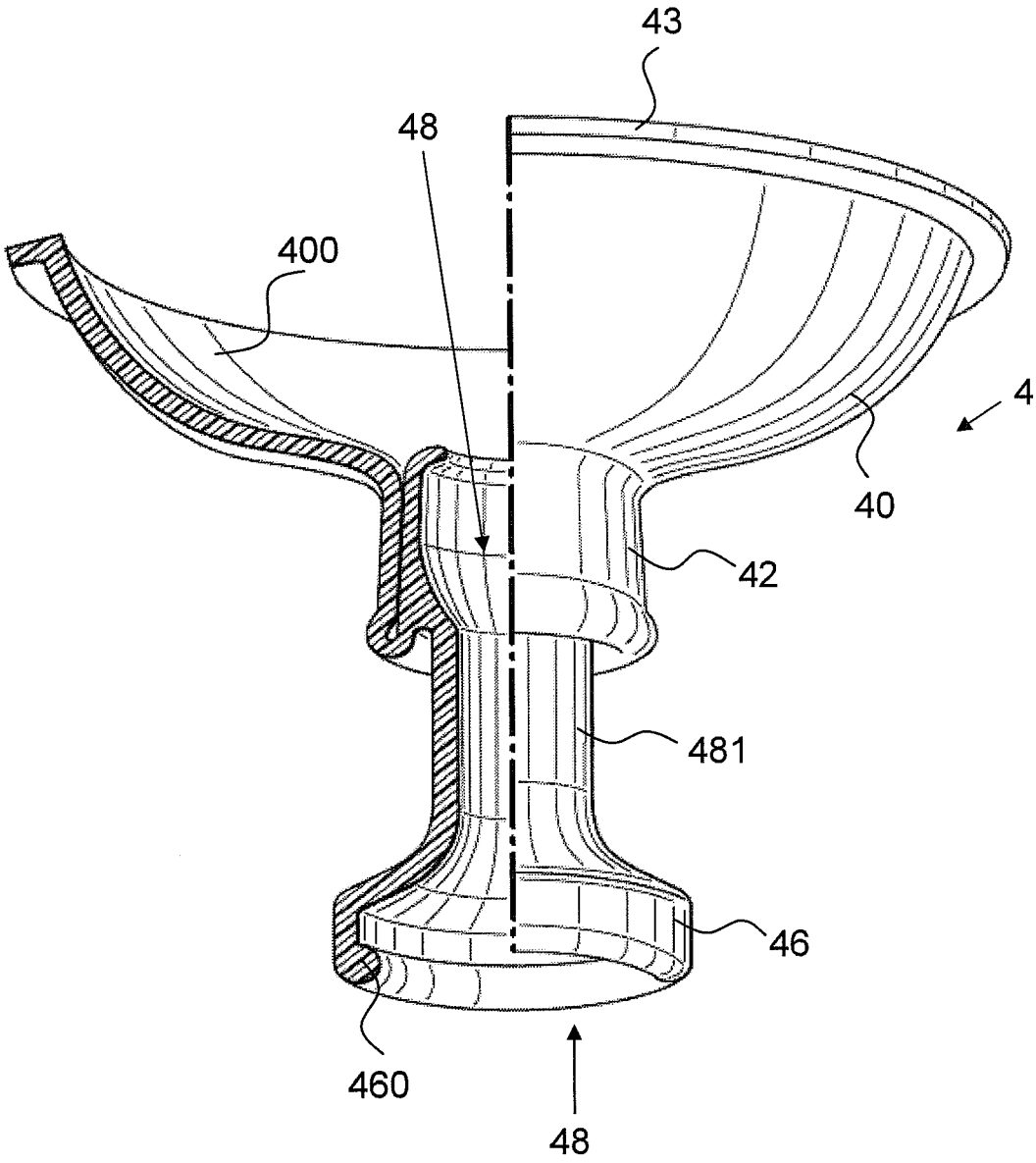
FIG. 9 shows a partial cross section of the teat according to FIG. 1 in a second inverted manifestation.

The teat has a third stable position and thus a second inverted manifestation. The tube 481 can be pulled out of the mouthpiece 42. The mouthpiece 42 can thus also be inverted to a stable position. The teat thus forms a shape in which the main body 40 is inverted in the direction of the mouthpiece 42, and the suction channel 48 is pulled out from the mouthpiece 42. This is shown in FIG. 9. In this way, the main body 40 encloses the mouthpiece practically from the upper end of the suction channel 48, i.e. from the tapered area 420. The teat that has been inverted in this way can be very easily cleaned. It is preferably also manufactured in this inverted position.

Figure 7:
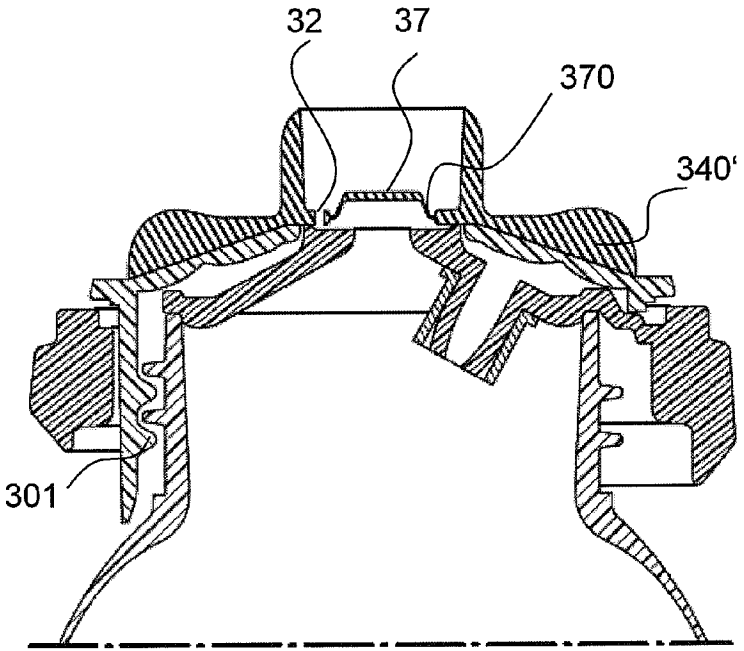
FIG. 7 shows a longitudinal section through the receiving unit according to FIG. 6, with opened valve.
Figure 6:
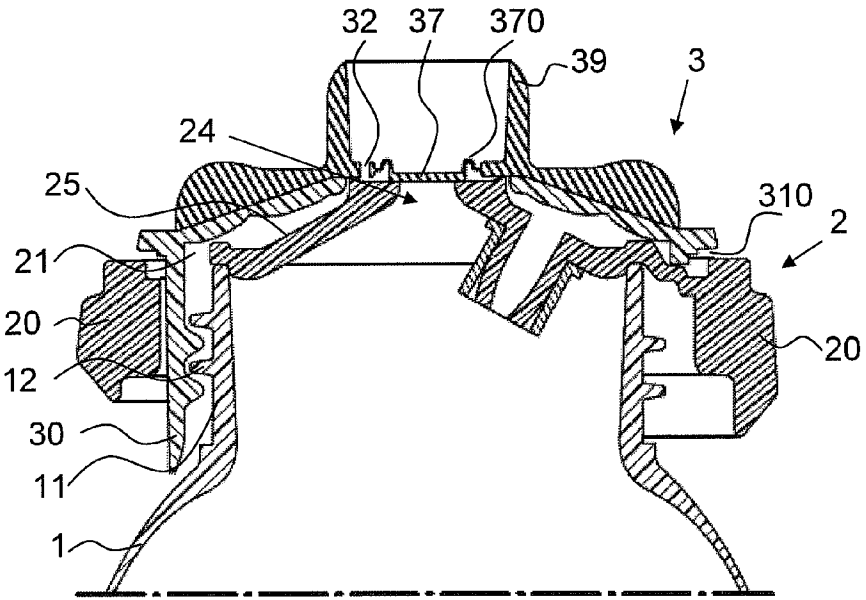
FIG. 6 shows a longitudinal section through a receiving unit for connection to the teat according to FIG. 1, with closed valve.

FIGS. 6 and 7 show another receiving unit for receiving the teat 4 according to the invention. The connection of the individual parts of the receiving unit is done similarly or in the same way as in the preceding example. Here, a closed valve diaphragm 37 is formed integrally on the receiving head 3. It covers the discharge opening 24 of the base part 2. In its peripheral area, which no longer covers the discharge opening 24, the valve diaphragm 37 has a small opening, namely the through-opening 32. This through-opening 32 is located over the inner surface 241 of the base ring 2.

The valve diaphragm 37 is preferably formed in one piece on the receiving head 3. Either it is the only part which is made of a soft material, and the rest of the head 3 is made of a hard material. However, it can for example also be made in one piece with further soft supporting structures, here supporting pads 340', and adhesively bonded on the hard part of the receiving head 3, welded to the latter or injection-moulded on it.

The valve diaphragm 37 is surrounded by an upright and circumferential collar 39, which can likewise be made from hard or soft material and in one piece with the rest of the receiving head 3. This collar 39 preferably has circumferential outer ribs, which are not shown here.

The valve diaphragm 37 forms a nonreturn valve which is connected to the rest of the receiving head 3 via a ring hinge 370. The through-opening 32 lying outside this ring hinge 370 forms a flow restrictor. This flow restrictor 32 has a smaller cross-sectional surface area than the following areas through which the liquid flows. In particular, the milk channel or central channel 48 and the suction opening 43 have a larger cross-sectional surface area. However, the suction channel 48 can have one or more constrictions spaced apart from the suction opening 43. As can be seen in the figures, the through-opening 32 and the nonreturn valve 37 are arranged outside the mouthpiece 42.

In FIG. 6, the nonreturn valve 37 is closed. No liquid is able to pass into the teat 4 through the discharge opening 24. The dead volume between discharge opening 24 and through-opening 32 is relatively small.

In FIG. 7, the nonreturn valve 37 is opened and frees the relatively large discharge opening 24. Liquid can pass through this discharge opening 24 to the through-opening 32 and thus into the mouthpiece 42.

The suction opening 43, and in a preferred embodiment also the milk channel 48, preferably has a cross-sectional surface area that is a multiple of the cross-sectional surface area of the through-opening 32. Typically, the cross-sectional surface area of the suction opening 43 is more than 10 times, in particular more than 50 times, and preferably more than 100 times, larger than that of the through-opening 32. Preferably, the whole area of the suction channel 48 extending within the mouthpiece 42 has a cross-sectional surface area that is larger by the abovementioned factors. Typical diameters are 7 mm for the suction opening 43 and 0.25 to 0.7 mm for the through-opening.

Further variations of the example depicted here are possible within the teaching according to the invention. Some examples are given below. Both the flow restrictor and also the nonreturn valve are present in this example. However, in a simpler embodiment not shown here, there is no nonreturn valve present, only the through-opening 32 forming the flow restrictor. This through-opening 32 can be arranged centrally or non-centrally in the head part 3. Moreover, several through-openings may be present, as long as they together have a cross-sectional surface area for the throughput of the liquid, this surface area being smaller than the cross-sectional surface area of the suction opening 43. The through-opening serving as flow restrictor can also be arranged in the base part 2.

Instead of the only one through-opening 32, several through-openings can be distributed about the peripheral circumference of the diaphragm. The area around the at least one through-opening can also be made from hard material, and the soft part of the diaphragm can be formed integrally thereon. Moreover, instead of the multi-part teat unit described here, a differently configured teat unit can also be provided with the arrangement, according to the invention, of a large suction opening and of a through-opening set back from the latter. For example, the liquid container can be provided with the discharge opening 24, which is closed by the diaphragm. Moreover, the chosen discharge opening 24 can be so small that it itself forms the through-opening and therefore the flow restrictor. The teat 4 can also be secured in a different way. For example, the skirt 46 can be plugged into the collar 39.

Figure 10:
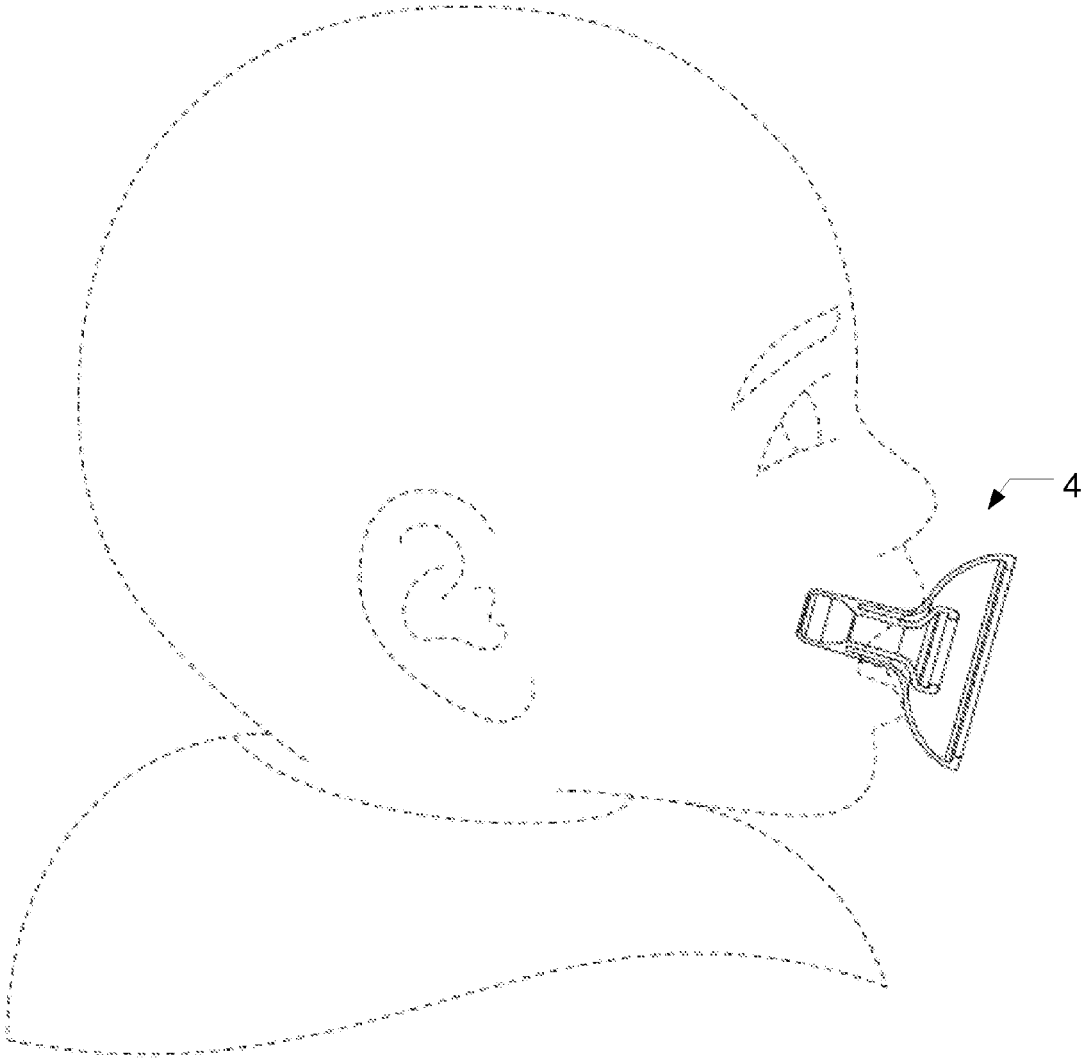
FIG. 10 shows the teat according to FIG. 1 in a baby's mouth.

The teat described here, with its abovementioned variations, permits a feeding action that is very true to nature, as is explained below:

During feeding, the mouthpiece of the teat is located in the baby's mouth, as for example shown in FIG. 10. The front part of the tongue and/or the lower lip, on the one hand, and the upper lip, on the other hand, enclose the teat sealingly from the outside. The mouthpiece reaches into the mouth almost as far as the transition from the hard palate to the soft palate. The front part of the baby's tongue presses against the mouthpiece from below, while the rear part of the tongue is lowered. A hollow space forms in the rear area, as a result of which an underpressure is generated in the mouth.

The gap 423 in the mouthpiece 42 forms an extensible zone which bears on the hard palate. In the text that follows, the expression air chamber is used instead of gap or zone. The air chamber bears substantially along its entire length on the hard palate.

The lower area of the double-walled mouthpiece 42 is pressed together. The underside of the mouthpiece 42 preferably also nestles on the tongue.

The flow of milk is substantially interrupted in this situation, particularly since the valve is closed.

If the baby now raises the rear area of its tongue, the upper area of the air chamber is compressed. However, if spacers are present in the gap, a reduced volume is retained. As before, the upper area of the air chamber 423 and the upper part of the mouthpiece 42 bear on the hard palate. The same applies to the lower part of the mouthpiece 42, which likewise bears on the tongue.

As it sucks on the teat, the baby now switches between these two positions, as a result of which an underpressure is generated cyclically, as if by a pump, and the milk channel is then opened. The upper area of the air chamber and if appropriate also the lower area of the air chamber stretch on account of the vacuum, similar to a balloon placed in a vacuum chamber. The change in volume of these areas takes place cyclically with the change of the underpressure prevailing in the mouth. This ensures that the mouthpiece of the teat behaves similarly to a natural nipple.

The lip, the hard palate and the tongue of the baby seal the gap 423 from the outside during feeding by deforming the main body 40 and the mouthpiece 42.

The teat according to the invention can be connected to the feeding bottle in a simple and hygienic manner, is easy to clean and permits a feeding action that is as true to nature as possible.

The invention claimed is:

1. A teat for connection to a receiving unit of a drink container, comprising a main body and, a mouthpiece having at least one suction opening and a free end, the mouthpiece adjoining the main body and being tapered relative to the main body, wherein the teat is designed in one piece, wherein the teat has a first connector element for connection to the receiving unit, and a second connector element for connection to the receiving unit, and a suction channel, wherein the suction channel extends within the mouthpiece, and opens via a first end into the suction opening and is directed via a second end towards the main body, and wherein the second end forms the first connector element for a substantially leak-tight connection to the receiving unit, wherein the suction channel extends at least partially in a tube that extends at least partially in an interior of the mouthpiece and is spaced apart from an inner face of the mouthpiece, wherein the tube has a first tube end, which is connected to the mouthpiece, and a second, free tube end forms the second end of the suction channel, wherein the first end of the tube ends in the interior of the mouthpiece, wherein the teat has a stable basic state, a first stable turned-back state and at least a second stable turned-back state, wherein the at least second stable turned-back state differs in outward appearance from the first stable turned-back state and from the stable basic state, wherein the main body is configured to turn back towards the free end of the mouthpiece at a first location into the first stable turned-back state, and the teat is configured to turn back at at least a second location into the at least one second stable turned-back state, wherein the mouthpiece is adapted to turn back towards the suction opening in the area of the connection to the first end of the tube, such that the tube lies substantially exposed in the turned-back state.

2. The teat according to claim 1, wherein the first end of the tube ends at a distance from the free end of the mouthpiece.

3. The teat according to claim 1, wherein the suction channel between the first end of the tube and the suction opening extends within a chamber in the interior of the mouthpiece.

4. The teat according to claim 3, wherein the mouthpiece, in an upper area adjacent to the suction opening, includes a single wall, and, in a lower area adjacent to the main body, includes a double wall.

5. The teat according to claim 1, wherein the mouthpiece, along part of its length, has a double wall including a circumferentially closed outer wall and, arranged at a distance from the outer wall, a circumferentially closed inner wall, wherein the inner wall forms said tube.

6. The teat according to claim 1, wherein the tube protrudes with the second end into the main body.

7. The teat according to claim 6, wherein the tube is widened in circumference in the area of the second end of the tube and forms a hollow cylindrical or conical skirt.

8. The teat according to claim 1, wherein the mouthpiece has a conical shape, at least over the area through which the tube passes, and wherein at least that part of the tube extending in the interior of the mouthpiece has a hollow cylindrical shape.

9. The teat according to claim 1, wherein the mouthpiece is flexible.

10. A teat unit for sucking a liquid from a liquid container, wherein the teat unit has a teat according to claim 1 and a flow restrictor with a through-opening, wherein the main body is formed integrally on the mouthpiece, and wherein the flow restrictor determines a maximum flow of the liquid passing through the suction opening from the liquid container, wherein the flow restrictor is arranged outside the mouthpiece, and wherein the suction opening has a greater cross-sectional surface area than the through-opening of the flow restrictor.

11. A teat unit for sucking a liquid from a liquid container, wherein the teat unit has a teat according to claim 1 and a flow restrictor with a through-opening, wherein the main body is formed integrally on the mouthpiece, and wherein the flow restrictor determines a maximum flow of a liquid passing through the suction opening from the liquid container, wherein the flow restrictor is arranged outside the mouthpiece, and wherein the teat unit has a one-way valve which is arranged outside the mouthpiece, and wherein the flow restrictor is arranged in the one-way valve or in an area adjacent thereto.

12. The teat according to claim 1, wherein the mouthpiece has a conical shape, at least over the area through which the tube passes, or wherein at least that part of the tube extending in the interior of the mouthpiece has a hollow cylindrical shape.

13. The teat according to claim 1, wherein the mouthpiece and the tube are flexible.

14. The teat according to claim 7, wherein the tube has a flange at the free end.

* * * * *